United States Patent [19]

Horst

[11] 4,384,832

[45] May 24, 1983

[54] ENGINE WITH COUNTER-ROTATING ROTORS HAVING HEMICYLINDRICAL PISTONS

[75] Inventor: Tallmon E. Horst, San Jose, Calif.

[73] Assignee: Horst Power Systems, Inc., Saratoga, Calif.

[21] Appl. No.: 331,983

[22] Filed: Dec. 18, 1981

[51] Int. Cl.[3] ..... F01C 1/26; F01C 17/02

[52] U.S. Cl. ..... 418/58; 418/151; 418/172; 418/187; 418/227

[58] Field of Search ..... 418/58, 61 R, 63, 151, 418/172, 183, 187, 188, 221, 227; 123/231, 237, 238

[56] References Cited

U.S. PATENT DOCUMENTS

| | | | |
|---|---|---|---|
| 2,324,434 | 7/1943 | Shore | 418/151 |
| 2,632,400 | 3/1953 | Marsh | 418/227 |
| 3,521,979 | 7/1970 | Horst | 418/226 |
| 3,867,075 | 2/1975 | Horst | 418/172 |

*Primary Examiner*—John J. Vrablik

*Attorney, Agent, or Firm*—Charles L. Lovercheck; Wayne L. Lovercheck; Dale R. Lovercheck

[57] ABSTRACT

A rotary engine having two opposite rotating rotors forming a substantial part of a toroidal chamber such that the toriodal chamber is parted into two lateral parts formed by an outer rotor having a disk-like part forming one side of the chamber and a lateral flange forming the outside and an inner rotor having a disk like part and a center hub forming the inside of the chamber, the rotors each having half cylinder shaped piston pockets which rotatably receive half cylinder shaped pistons that are rotatably supported on their rotors. The pistons are rotated in the same direction with respect to each other and are carried around the toroidal chamber by the rotors as they rotate in opposite directions on the rotors forming an expansion chamber between the pistons as they rotate. The pistons are rotated by stationary gears and the pistons pass each other in the expansion chamber twice on each rotation of the engine. The axis of rotation of the pistons is parallel to the axis of rotation of the rotors.

A unique steam admission system is also provided.

22 Claims, 17 Drawing Figures

FIG. 1
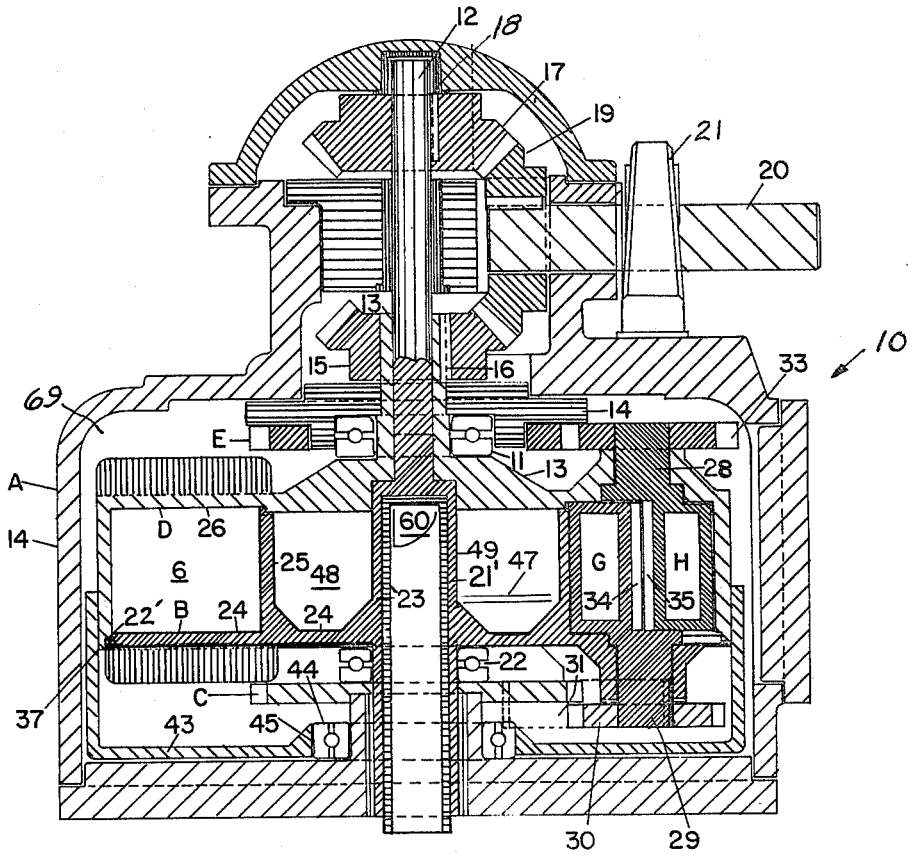
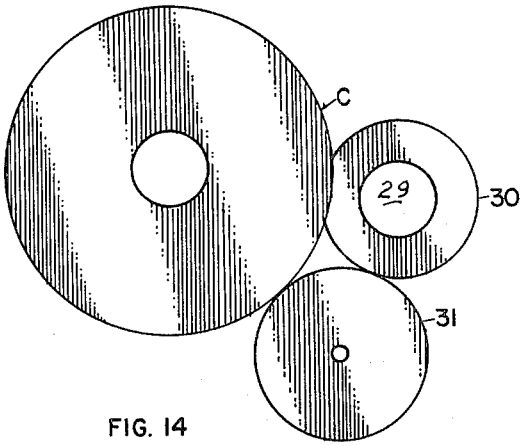
FIG. 14

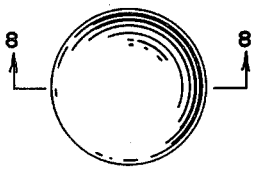
FIG. 6
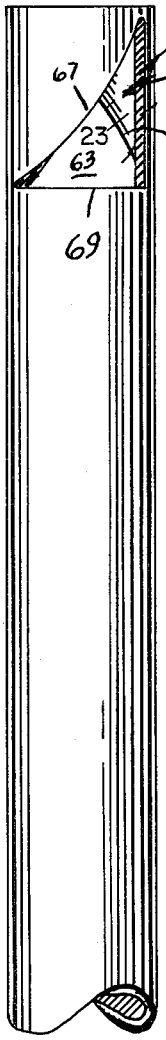
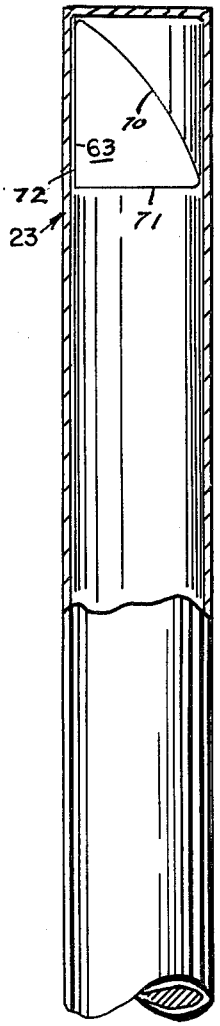
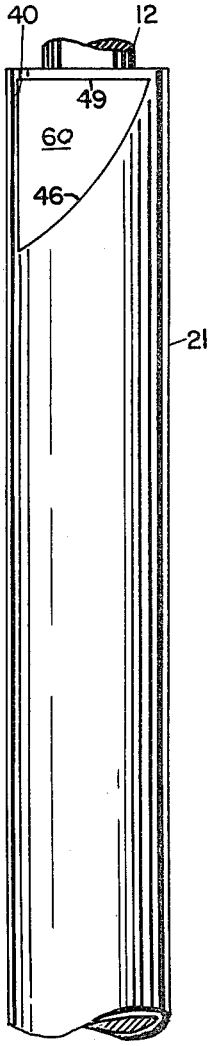
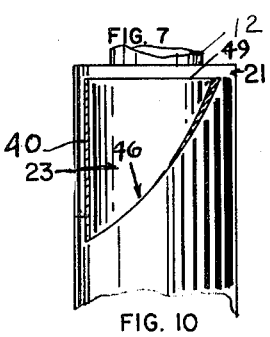
FIG. 7
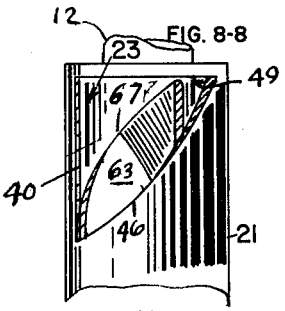
FIG. 8-8
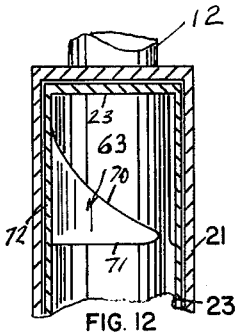
FIG. 10
FIG. 11
FIG. 12
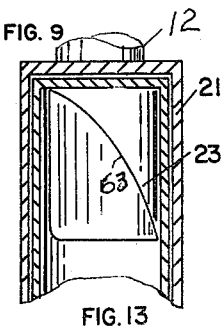
FIG. 9
FIG. 13

ENGINE WITH COUNTER-ROTATING ROTORS HAVING HEMICYLINDRICAL PISTONS

REFERENCE TO PRIOR ART

Prior art known to applicant is applicants own U.S. Pat. Nos. 3,521,979 and 3,867,075 and the patents cited therein. These prior patents disclose a rotary engine having a toroidal shaped expansion chamber that receives hemispheric shaped pistons that rotate about an axis perpendicular to the axis of rotation of the engine.

Applicants' pistons in the present disclosure are hemicylinderical shaped and they rotate about axis that are parallel to the axis of rotation of the engine. This structure has several important advantages over that of the references:

1. The present expansion chamber is rectangular in cross-section but could be other shapes. The previous expansion chamber had to be circular in cross-section which is a difficult shape to manufacture.
2. Applicants' pistons are much more economical and simpler to manufacture.
3. The drive gears for the pistons may be spur gears in the present invention where they had to be more expensive bevel gears which are in the previous invention.
4. The present invention is much simpler to assemble than the structure shown in the previous patents.
5. The mounting of the counter weights in the present invention is much simpler than the mounting of the pistons and counterweights shown in previous patents, and permit greater rotor diameters.

OBJECTS OF THE INVENTION

It is an object for the invention to provide an improved rotary engine.

Another object of the invention is to provide a rotary engine that is simple in construction, economical to manufacture, and simple and efficient to use.

Another object of the invention is to provide a rotary engine that has an expansion chamber that is four-sided in cross-section with hemicylindrical pistons in the chamber.

Another object of the invention is to provide a rotary engine that has an expansion chamber that is formed by concentric axially extending flanges on plate like rotor members. Another object of the invention is to provide a unique structure for feeding fluid under pressure to an engine.

With the above and other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF DRAWING

FIG. 1 is a longitudinal cross-section view of the engine according to invention.

FIG. 6 is an end view of the steam feed tube.

FIG. 7 is a side view of the steam feed tube.

FIG. 8 is a view of the steam feed tube, shown in cross secton.

FIG. 9 is a side view of an end of the second rotor shaft.

FIG. 10 is a top view of the steam feed tube and a hollow shaft with steam feed slots out of alignment with one another.

FIG. 11 is a view of the steam feed tube and second shaft showing second slot aligned with first slot.

FIG. 12 is a longitudinal cross sectional view of the steam tube and second shaft.

FIG. 13 is a longitudinal cross sectional view of the lower slot in closed position.

FIG. 14 is a front view of the idler gear showing it in mesh with the stationary gear and second piston gear.

DETAILED DESCRIPTION OF DRAWING

Figure 2:
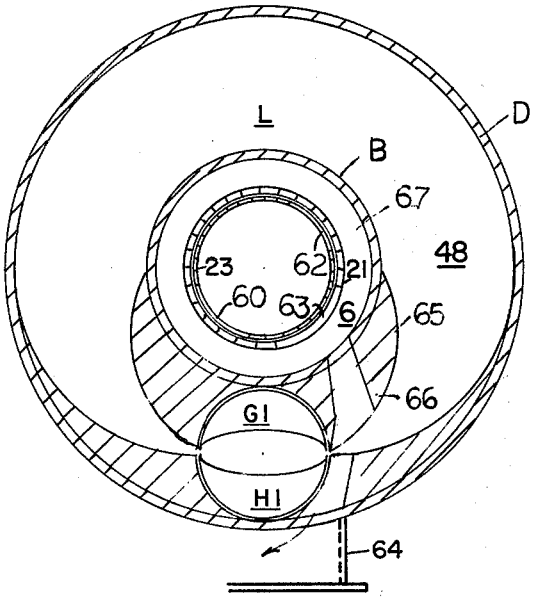
FIG. 2 is a schematic transverse cross-sectional view of the engine with pistons in a first position.
Figure 3:
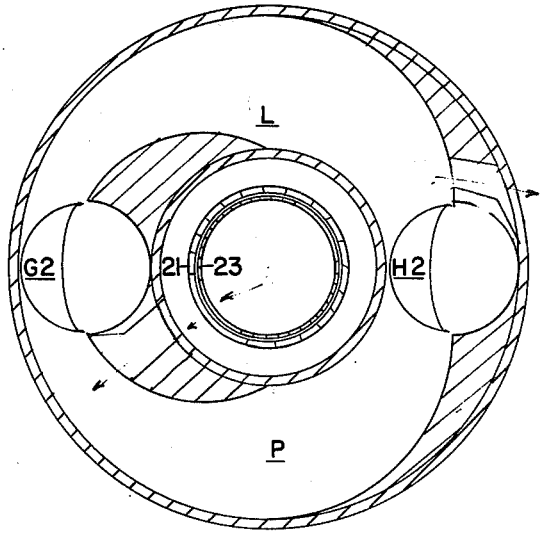
FIG. 3 is a schematic view of the engine with rotors and pistons rotated 90 degrees from the position shown in FIG. 2.

The engine disclosed herein is a rotary type engine 10 made up of a stationary housing A a first shaft 12 rotatably supported on the housing and a first rotor B fixed to the first shaft. A second shaft 13 rotatably supported on the housing and concentric to the first shaft and having the second rotor D attached to it. The first shaft 12 is rotatably received in the second shaft 13 which rotates outside it. The second rotor D has a hollow boss on it which forms second shaft 13 which is received in the bearing 11 which is supported in the frame member 14.

The first shaft 12 and the second shaft 13 with bevel gears 15, 17, and 19 synchronize the rotation of rotors A and B and drive output shaft 20. The second shaft 13 on the second rotor D has the bevel gear 15 keyed to it by key 16 and the first shaft 12 has the bevel gear 17 keyed to it by key 18. Synchronizing gear 19 meshes with the gears 15 and 17 and provides an output to shaft 20 which is piloted in the pillow block 21'.

The shaft 12 has a tubular end 21' which is rotatably received in thrust bearing 22 which prevents the first rotor B from moving away from the second rotor D thereby causing a steam leak at the labyrinth seal 22'. Thus the thrust bearing 22 is restrained from outward movement by the fixed gear C which is fixed to the housing A and the thrust bearing 11 is restrained from axial movement by the frame member 14.

Thus the stationary gears C and E are fixed to frame A and piston spur gears 33 and 30 are driven by gears C and E. Gear 30 is driven by stationary gear C through idler 31 or reversing gear, therefore, rotors B and D rotate in opposite directions and carry pistons G and H respectively with them.

It will be noted that the hollow part 21 of first shaft 12 is integrally attached to the first shaft 12, and has a hollow therein that receives the steam metering tube 23 which may be connected to a suitable source of steam or other fluid. Thus the engine can be operated as a motor by admitting fluid under pressure to tube 23. It may also be operated as a pump by making appropriate connections to a source of fluid to become pressurized and applying external driving power to shaft 20.

The inner rotor B has a round radially extending disk-like body 24 disposed in a plane perpendicular to shaft 12 with a peripheral grooved edge forming a part of the labyrinth seal 22'. A cylindrical flange 25 is integrally attached to the disk-like portion 24 adjacent its center and a piston shoulder 66 is integral with its outer surface and forms the inner side of the toroidal shaped chamber 6. While the outer peripheral part 26 of the disk-like body 21 forms the one lateral side of the toroidal chamber 6.

The inner rotor B as the inner piston G rotatably supported on it by its shaft 29 and is received in a piston in piston shoulder 65. Shaft 29 has the piston gear 30 on its outer end. Piston spur gear 30 meshes with the idler or reversing gear 31. The idler gear 31 is twice the thickness of the other gears. The idler gear 31 is carried on a shaft which is fixed to the inner rotor B.

The inner rotor has a shoulder 65 with a steam port 66 which communicates with the space 48 and is connected to the steam tube intermittently when either slot 60 or 62 aligns with slot 63.

Hollow shaft 21 has a triangular shaped slot 60 bounded by a curved hypotenuse 46 and a flat end 49 and a flat side 40. Hollow shaft 21 receives the steam tube 23 that may be connected to a suitable source of steam. The steam tube 23 has two triangular slots 62 and 63 that are identical in shape but inverted with respect to the triangular slot 60 that is the side of the shaft 21. The slots 62 and 63 are identical in shape and 180 degrees apart in the steam tube. Slot 62 has a hypotenuse 67, a side 68 and an end 69. Slot 63 has hypotenuse 70, end 71 and side 72.

The outer disc D has a piston shoulder 68, contains a pocket for piston H and has an exhaust port S for exhausting steam into the chamber 69.

The outer rotor D has a disk-like body 26 which has a peripheral cylindrical flange forming a part of the labyrinth seal 22'. The cylindrical flange is integrally attached to the disk-like portion 26 and forms a side of the toroidal shaped chamber 6 which is four-sided in cross section.

FIGS. 2 through 5 and FIG. 15 schematically show the several positions of the pistons and rotors in one complete rotation of the rotors and pistons.

Assuming that the inner rotor B rotates clockwise, as seen from above and the outer rotor D rotates counter clockwise, then piston H will rotate in its pocket in a counter clockwise direction and the piston G will also rotate clockwise in its pocket in shoulder 66 due to the reversing gear.

Figure 2A:
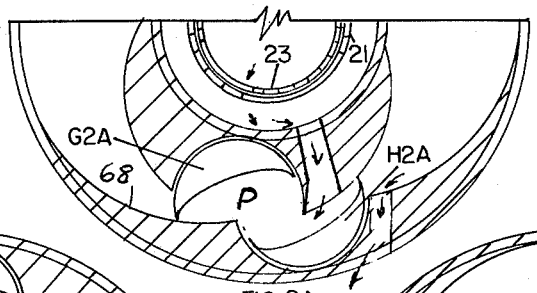
FIG. 2A is a view like FIG. 2 showing the rotors moved 10° from the passing position, steam slots aligned to start another power stroke.
Figure 4:
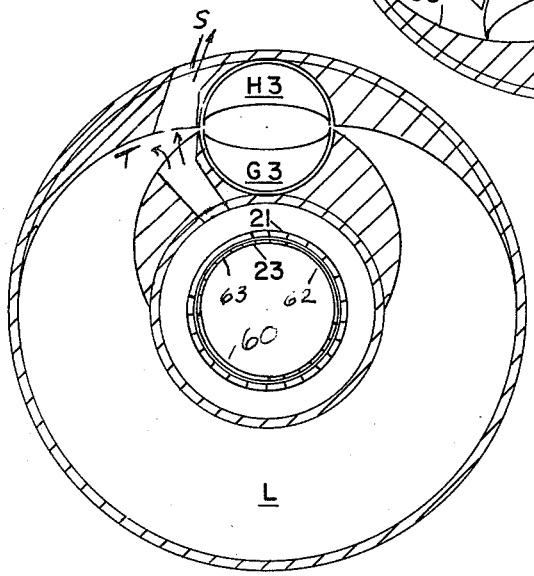
FIG. 4 is a schematic view similar to FIG. 3 showing the rotors and pistons rotated 180 degrees from the position shown in FIG. 1.
Figure 5:
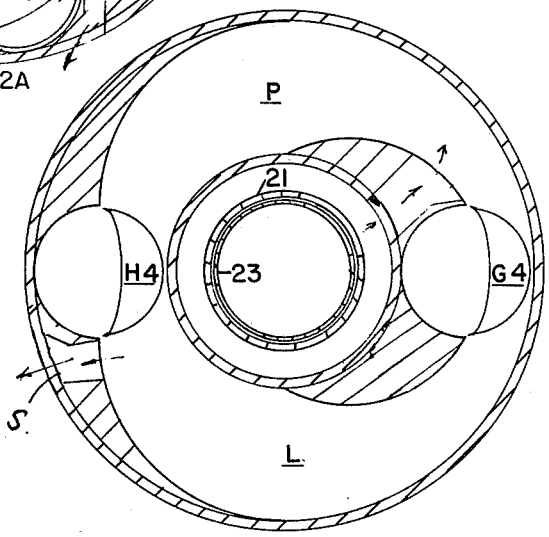
FIG. 5 is a schematic view similar to FIGS. 2, 3, and 4 of the pistons and rotors rotated to 170 degrees from FIG. 2.
Figure 15:
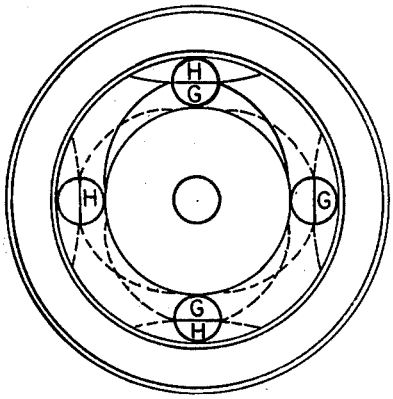
FIG. 15 is a schematic view showing the pistons in the positions they will take during each 90 degrees rotation.
Figure 16:
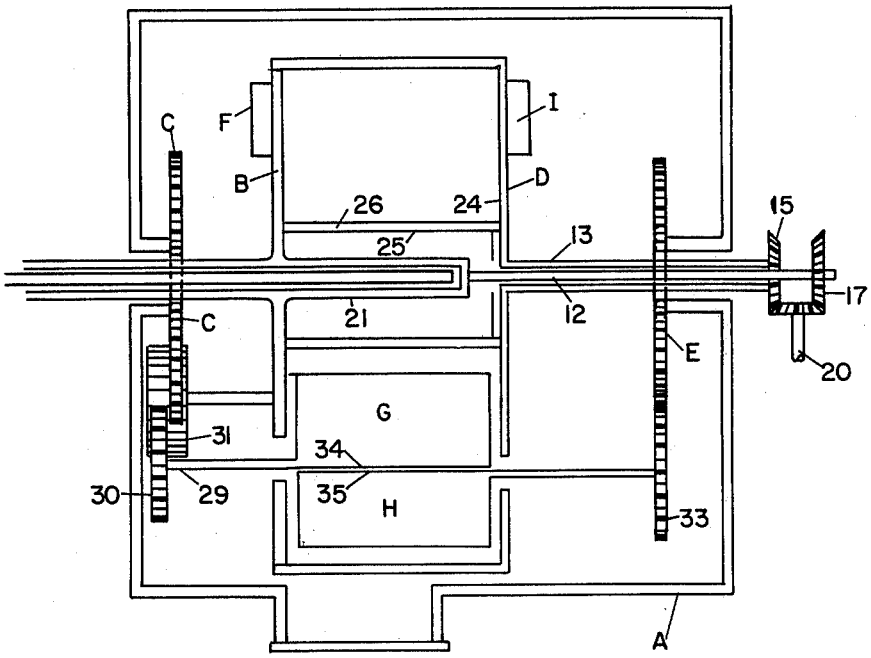
FIG. 16 is a schematic view of the mechanical drive of the engine.

As the rotors rotate and the pistons move in their pockets, when the rotors have moved 10° from the starting position shown in FIG. 2 to the position shown in FIG. 2A, the slots 60 and 62 will register and steam will enter the space P between the pistons G and H pushing them away from each other. The pistons G and H will move in close relation to the inner periphery of the toroidal chamber through the position shown in FIG. 4 where the pistons will pass and steam from the chamber P will then become low, as indicated at L in FIG. 4 due to steam exhausting through exhaust port S. Pressure will then enter the space between pistons G and H as the as slots 62 and 63 register and the pressure will be exerted on the opposite sides of the pistons thus driving them through a new cycle. Decayed steam will exhaust through S from the chamber marked L. The rotors will continue to rotate, bringing the pistons back to the position shown in FIG. 2, thereby completing one complete rotation and two power cycles. The cycles will then repeat.

Operation

In operation as a motor, a source of fluid under pressure will be connected to the steam metering tube 23. The metering tube will be oriented so that one of the openings 60 and 62 is aligned with the slot 63 in the hollow shaft 21 at the time the pistons begin to move away from each other in the toroidal chamber to the position shown in FIG. 2.

As the pistons continue to move apart, fluid from the metering tube will enter the space P in the toroidal chamber between the pistons G and H as they begin to move away from each other to the positions to the positions G2 and H2. The fluid under pressure will exert a force on the pistons which will urge them to move away from each other and therefore result in an output force on the shaft 20. This force will continue until the pistons pass each other in the toroidal chamber. Then the slot 62 in the metering tube will move in alignment with the slot 63 in the hollow shaft and steam again will be emmitted to the pistons in the positions G3 and H3 and G4 and H4.

It will be seen that when the slot 63 in the hollow shaft is aligned with one of the slots 60 and 62 in the metering tube, steam will enter the toroidal chamber through the steam port 65 and in the rotor.

In the embodiment of the invention shown, gears C and E are fixed to the stationary housing A. Obviously gears C and E could be driven at the same speed or at different speeds to change the relative rate of movement of the pistons and rotors. The rate of relative rotation of gears C and E could also be changed or one of rotors B and D could be held in fixed position.

The rate of relative rotation of the gears 15 and 17 could be changed to provide different speed ratios. The factor of importance is that pistons G and H pass each other when their open sides face each other.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. An engine, comprising, a first rotor and a second rotor, a means supporting said rotors on a common axis whereby at least one said rotor rotates about said common axis, means on said first rotor and means on said second rotor co-operating to form a toroidal chamber, a first piston disposed in said chamber and a second piston disposed in said chamber, means attached to said first piston and means attached to said second piston restraining said pistons for relative movement to each other in synchronism in opposite directions around said common axis to pass each other at definite positions in said toroidal chamber, means on said rotors to rotate said first piston about a first axis and means to rotate said second piston about a second axis parallel to said first axis at all times, output means connected to said rotors, and means to introduce fluid to said toroidal chamber adjacent said positions after said pistons meet, whereby said fluid forces said pistons to have relative movement in opposite direction from each other in said toroidal chamber and means to exhaust the fluid from said chamber.

2. The engine recited in claim 1 wherein said means to introduce fluid under pressure to said toroidal chamber comprises a first tubular member having fluid under pressure therein and having a slot in its outer peripheral edge, one said rotor having a axle thereon having a hollow portion receiving said tubular member and having a slot in the outer periphery thereof adapted to register with said slot in said first tubular member at a time when said pistons meet whereby said fluid under pressure is admitted to the space between said pistons urging said pistons to move away from each other.

3. The engine recited in claim 2 wherein said first rotor comprises a radial flange thereon extending axially towards said second rotor forming a portion of said toroidal chamber and said second rotor has radial flange thereon extending towards said first rotor whereby a second side of said toroidal chamber and sealing means sealing said flanges to said rotors for relative movement thereof.

4. The engine recited in claim 3 wherein said pistons have the shape generally of half cylinders of equal diameter and said toroidal chamber is rectangular in cross section, said pistons are rotatable in said chamber to pass each other with their centers co-extensive with each other in said toroidal chamber at the time of passing.

5. The engine recited in claim 4 wherein one said rotor has a laterally extending flange thereon making sealing engagement with the other said rotor and the other said rotor has a laterally extending flange thereon making sealing engagement with the other said rotor, said flanges on said rotors providing said chamber.

6. The engine recited in claim 4 wherein a first radially extending flange is supported on said first rotor and a second radially extending flange is attached to said second rotor and a first axially extending flange and a second axially extending flange are each attached to at least one said rotor, said radially extending flanges and said axially extending flanges define said toroidal chamber.

7. The engine recited in claim 4 wherein a first thrust bearing engages said first rotor restraining its movement away from said second rotor and a second thrust bearing supports said second rotor restraining its movement away from said first rotor to hold said flanges in sealing engagement with said rotors.

8. The engine recited in claim 7 wherein said means restraining said pistons to move in synchronism comprises a first stationary gear and a second stationary gear spaced from each other and fixed to said engine, said first piston has a first piston gear engaging said first stationary gear and said second piston has a second piston gear engaging said second stationary gear through an idler gear, whereby said second piston is rotated in a direction opposite said first piston.

9. The engine recited in claim 8 wherein said rotors rotate about an axis parallel to the axis in rotation of said pistons.

10. The engine recited in claim 9 wherein said means on said rotors forming said toroidal chamber comprises flanges on rotors.

11. The engine recited in claim 10 wherein said output means comprises a first shaft attached to said first rotor and a second shaft attached to said second rotor, said first shaft and said second shaft being supported on a common axis and output means connected to one of said shafts.

12. The engine recited in claim 11 wherein said piston gears are half the diameter of said stationary gears.

13. The engine recited in claim 12 wherein both said first piston gear and said second piston gear are rotatable in the same direction to each other and said synchronizing means comprises a reversing gear means connecting said first piston gear to said second piston gear.

14. The engine recited in claim 13 wherein said second shaft has said hollow portion receiving said first tubular member and said first shaft has a hollow portion receiving said second shaft.

15. The engine recited in claim 13 wherein said synchronizing means comprise a first beveled gear on said first shaft and second has a beveled gear on said second shaft and a drive gear disposed between said first beveled gear and said second beveled gear.

16. The engine recited in claim 15 wherein said first rotor has a first counter weight supported thereon diametrically opposite said first piston and then said second rotor has a second counter weight supported thereon diametrically opposite said second piston.

17. The engine recited in claim 11 wherein said first rotor is supported on a first shaft, said second rotor is supported on a second shaft concentric to said first shaft, said first shaft has a first gear thereon, and said second shaft has a second gear thereon and output gear engaging said first gear and said second gear whereby said rotors are restrained to rotate in synchronism with each other and output means is connected to one of said gears.

18. The engine recited in claim 11 wherein said means restraining said pistons to move in synchronism comprises a first gear and a second gear, at least one of said first gear and said second gear being stationary with said engine.

19. The engine recited in claim 2 wherein said first rotor has a fluid port therein connecting said toroidal chamber with said first tubular member and said second rotor has an exhaust port therein connecting said toroidal chamber with an exhaust means.

20. The engine recited in claim 19 wherein said slots in said first tubular member and in said exhaust means are triangular in shape.

21. The combination recited in claim 19 wherein two said slots are formed in said tubular member, said slots being disposed at 180 degrees from each other on the outer periphery of said tubular member.

22. An engine comprising a casing, a shaft means supported on said casing, a rotor supported on said shaft means, a toroidal chamber in said rotor, a first hemicylindrical piston and a second hemicylindrical piston in said toroidal chamber, said pistons each having an axis of rotation disposed parallel to each other at all times, each said piston being adapted to move relative to the other in said toroidal chamber and adapted to move away from each other in said toroidal chamber as they rotate in a continuous path in said toroidal chamber, means on said rotor rotatably supporting said pistons maintaining said pistons in synchronism with each other, said pistons engaging surfaces of said toroidal chamber for providing closure means in said chamber to close said chamber with no angular space between said pistons at a first position and a second position providing a space between said pistons as said pistons move toward each other on one side of each said piston and a second chamber on a second side of said pistons on the side thereof moving away from each other, and means to introduce a fluid to said chamber on the side of said pistons moving away from each other and means to remove fluid from said chamber on the side of said pistons moving away from each other, whereby said pistons are forced around said chamber, and output means connected to said synchronizing means.

* * * * *